US012196521B2

(12) United States Patent
Tippmann, Jr. et al.

(10) Patent No.: US 12,196,521 B2
(45) Date of Patent: Jan. 14, 2025

(54) SPEED LOADER

(71) Applicant: Tippmann Arms Company, LLC, Fort Wayne, IN (US)

(72) Inventors: Dennis J. Tippmann, Jr., Fort Wayne, IN (US); Bradley Wyatt Sordelet, Fort Wayne, IN (US)

(73) Assignee: Tippmann Arms Company, LLC, Fort Wayne, IN (US)

( * ) Notice: Subject to any disclaimer, the term of this patent is extended or adjusted under 35 U.S.C. 154(b) by 125 days.

(21) Appl. No.: 18/162,763

(22) Filed: Feb. 1, 2023

(65) Prior Publication Data

US 2023/0358492 A1 Nov. 9, 2023

Related U.S. Application Data

(60) Provisional application No. 63/355,729, filed on Jun. 27, 2022, provisional application No. 63/305,400, filed on Feb. 1, 2022.

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83
See application file for complete search history.

(56) References Cited

U.S. PATENT DOCUMENTS

| | | | | |
|---|---|---|---|---|
| 10,156,408 | B1 * | 12/2018 | Buckner | F41A 9/83 |
| 11,536,527 | B1 * | 12/2022 | Selph | F41A 9/83 |
| 2017/0067707 | A1 * | 3/2017 | Zivic | F41A 9/83 |

* cited by examiner

*Primary Examiner* — J. Woodrow Eldred
(74) *Attorney, Agent, or Firm* — Barnes & Thornburg LLP

(57) ABSTRACT

A speed loader is provided with a hopper configured to receive a plurality of rounds of ammunition. There is a magazine receiving portion configured to receive an open end of a magazine. The speed loader includes a track body extending between the hopper and the magazine receiving portion. The track body defines a passageway dimensioned to transfer one or more of the plurality of rounds from the hopper to the magazine receiving portion. The passageway may be configured to orient rounds in a single file fashion between the hopper and the magazine receiving portion. The speed loader also includes a round loading assembly configured to successively load rounds from the track into the open end of the magazine.

20 Claims, 10 Drawing Sheets

SPEED LOADER

RELATED APPLICATIONS

This application claims the benefit of U.S. Provisional Application No. 63/355,729, filed Jun. 27, 2022 for a "Speed Loader" and U.S. Provisional Application No. 63/305,400, filed Feb. 1, 2022 for a "Speed Loader," both of which are hereby incorporated by reference in their entireties.

BACKGROUND

Many semi-automatic and automatic firearms use a magazine that holds a plurality of ammunition rounds to be fired. Typically, the magazine has a spring-loaded follower that urges rounds, one-by-one, into the firearm for firing. Once the magazine is out of ammunition, the user must refill the magazine with ammunition, either manually or with a loading device. However, the reloading of the magazine tends to be a tedious and time-consuming process.

Some types of ammunition, such as 0.22 long rifle ("LR"), are coated with a wax lubricant. Unfortunately, over time the wax can build up in magazines and devices used to load magazines. The wax build up tends to get gummy and slows down movement of ammunition. As a result, magazines and loaders must be periodically cleaned. Typically, these devices are cleaned with bottle brushes and hot water, which can be a tiresome task.

Therefore, there is a need for a device that overcomes one or more of these issues.

SUMMARY

According to one aspect, this disclosure is a speed loader. In some embodiments, the speed loader includes a hopper configured to receive a plurality of rounds of ammunition. There is a magazine receiving portion configured to receive an open end of a magazine. The speed loader includes a track body extending between the hopper and the magazine receiving portion. In some cases, the track body defines a passageway dimensioned to transfer one or more of the plurality of rounds from the hopper to the magazine receiving portion. The passageway may be configured to orient rounds in a single file fashion between the hopper and the magazine receiving portion. The speed loader also includes a round loading assembly configured to successively load rounds from the track into the open end of the magazine.

According to another aspect, this disclosure provides a method of loading rounds of ammunition into a magazine of a firearm. The method includes the step of loading a plurality of rounds into a hopper of a speed loader. The speed loader is shaken until at least a portion of the rounds have entered a passageway extending from the hopper of the speed loader. The magazine is latched into a loading end of the speed loader. Next, the crank handle of the speed loader is rotated to load rounds in the passageway into the magazine. The speed loader includes a round loading assembly configured to successively load rounds from the passageway into the magazine responsive to rotating the crank handle.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale.

Where considered appropriate, reference labels have been repeated among the figures to indicate corresponding or analogous elements.

DETAILED DESCRIPTION OF THE DRAWINGS

Figure 1:
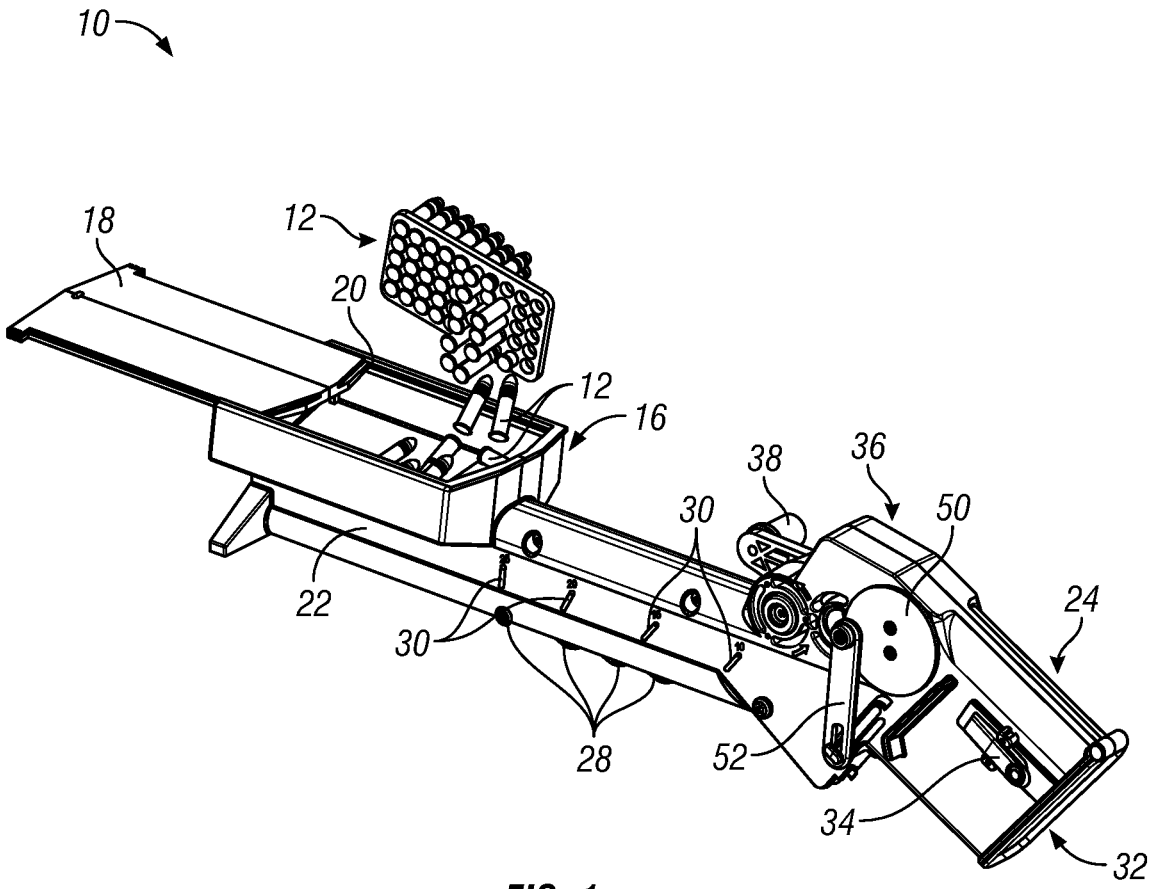
FIG. 1 is a left side perspective view of a speed loader with the lid open according to an embodiment of this disclosure.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

Figure 2:
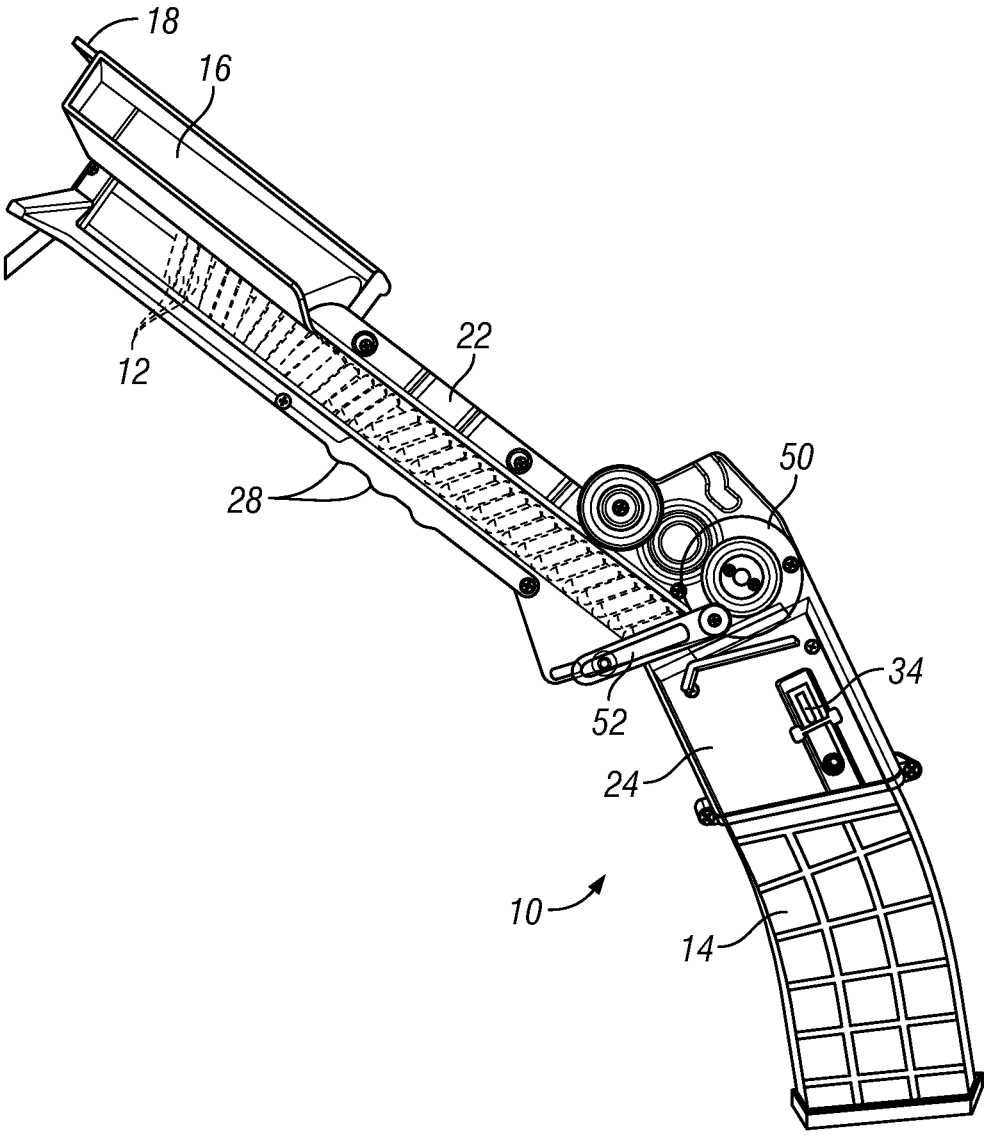
FIG. 2 is a left side perspective view of the speed loader shown in FIG. 1 with a magazine connected for loading rounds of ammunition.
Figure 3:
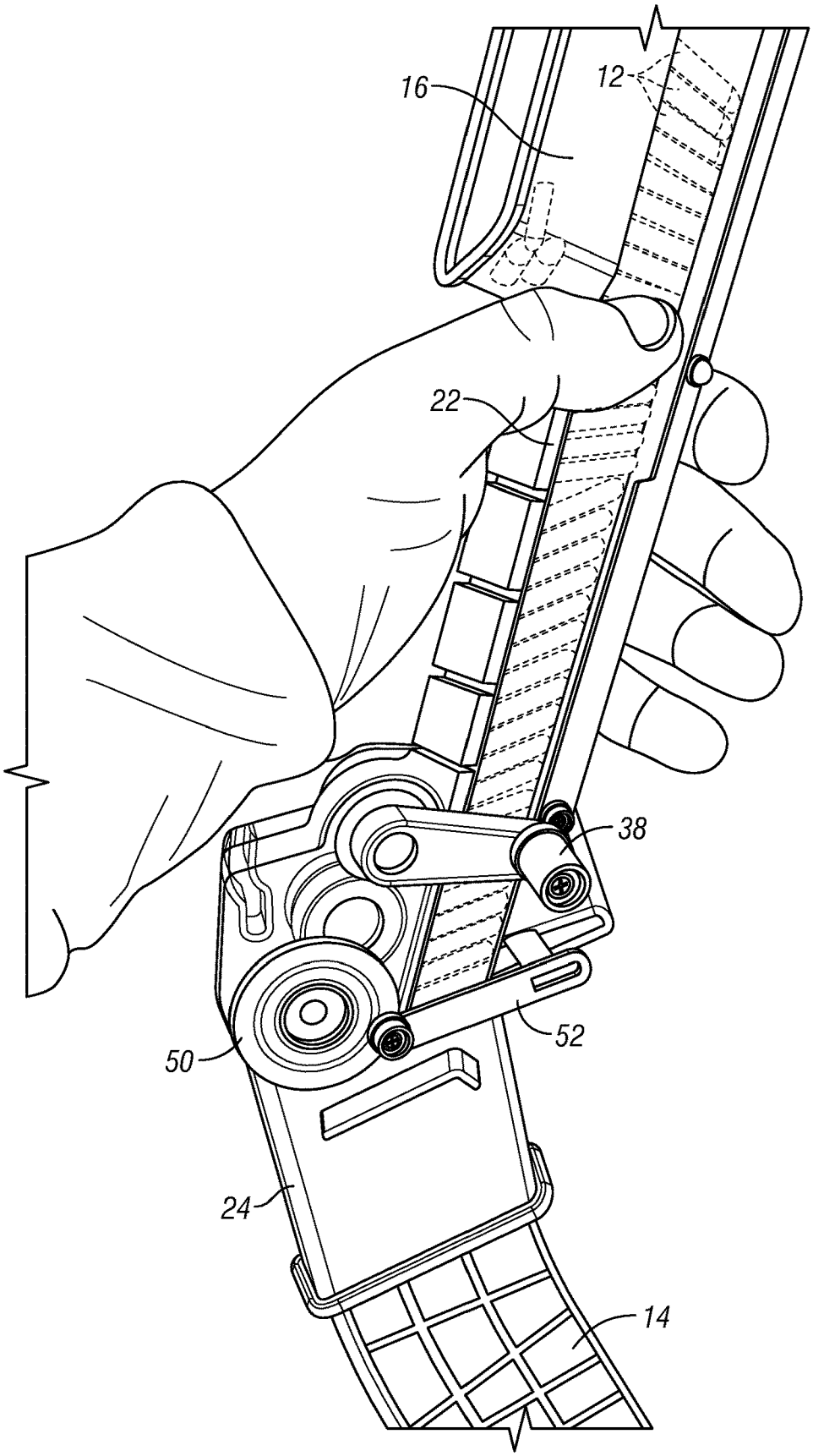
FIG. 3 is a right side perspective view of the speed loader shown in FIG. 2.

In some embodiments, this disclosure provides a speed loader 10 for loading rounds 12 of ammunition into a magazine 14 (FIGS. 2 and 3). In the embodiment shown, the speed loader 10 includes a hopper 16 that is dimensioned to receive a plurality of rounds 12. For example, in some embodiments, the hopper 16 could be sized to accommodate 100 rounds 12. Depending on the circumstances, the hopper 16 could be sized to receive more or less than 100 rounds. In the embodiment shown, the hopper 16 includes a lid 18 that is movable between an open position (as shown in FIG. 1) to load the hopper 16 with rounds 12 and a closed position that prevents the rounds 12 from exiting the hopper 16 out of the opening that is covered by the lid 18. As shown, the lid 18 is slidable between open/closed positions along slot 20 defined in interior sidewalls of the hopper 16.

Figure 5:
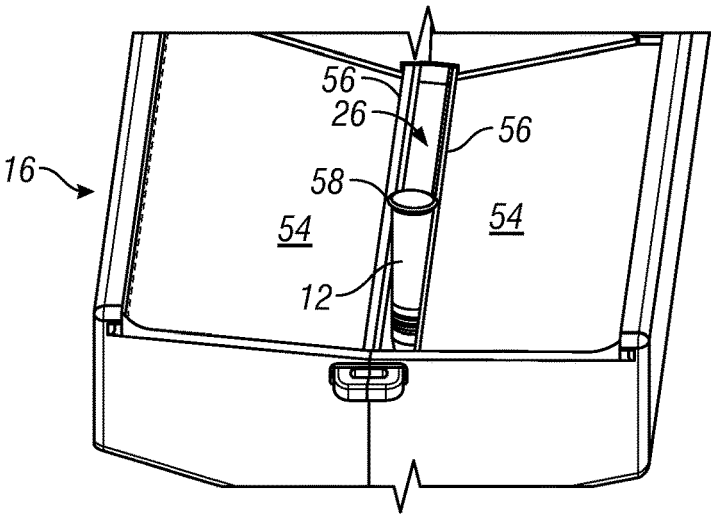
FIG. 5 is a detailed perspective view of an example hopper with the lid removed to reveal a passageway along which rounds travel to the magazine.
Figure 6:
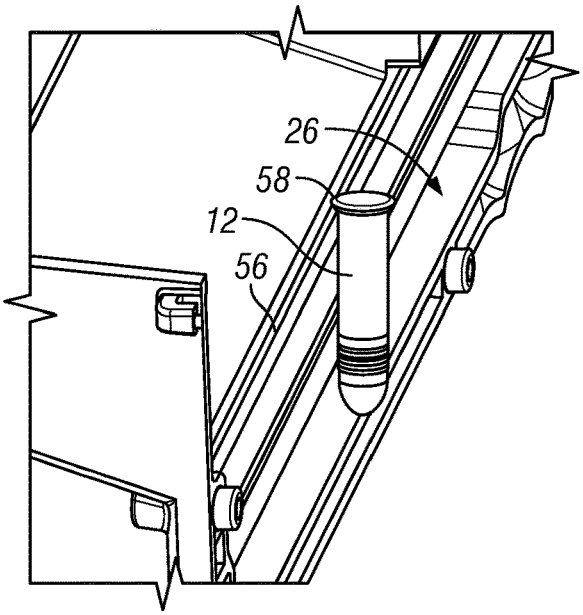
FIG. 6 is a detailed perspective view with half the hopper removed to reveal a shelf that engages the rim of the ammo to orient the rounds in the passageway.

As shown, the speed loader 10 includes a track body 22 that extends below the hopper 16. As shown, the track body 22 extends to a magazine receiving portion 24. There is a passageway 26 (FIGS. 5 and 6) that allows rounds 12 in the hopper 16 to enter the track body 22. The rounds 12 enter the passageway 26 from the hopper 16 via gravity and travel through the track body 22 to the magazine receiving portion 24 to be loaded into the magazine 14. For example, a force from the user shaking the speed loader 10 could allow the rounds 12 to enter the passageway 26 and travel through the track body 22 to the magazine receiving portion 24. In the embodiment shown, the track body 22 includes a portion configured to be held by the user to shake the speed loader 10. For example, in some cases, the track body 22 may include finger grip grooves 28 for aid in holding the track body 22 (see FIG. 3). In some embodiments, an external surface of the track body 22 includes markings 30 indicating a number of rounds 12 loaded into the track body 22. For example, at least a portion of the track body 22 could be transparent or translucent so the user can see how many rounds 12 are loaded compared to the markings 30 on the track body 22.

The magazine receiving portion 24 includes an open end 32 that is dimensioned to receive a magazine 14. In the embodiment shown, an external surface of the magazine receiving portion 24 includes a latch mechanism 34 configured to couple the magazine 14 with the magazine receiving portion 24. After loading the magazine 14 with rounds 12, the user can actuate the latch mechanism 34 to allow the magazine to be detached from the magazine receiving portion 24 and removed.

The speed loader 10 includes a round loading assembly 36 configured to successively load rounds 12 from the passageway 26 into the magazine 14. In the embodiment shown, the round loading assembly 36 is actuated by rotating a crank handle 38. The user rotates the crank handle 38 until the magazine 14 is fully loaded with rounds 12. As discussed herein, the round loading assembly 36 includes a pusher 40 and plunger 42 (FIGS. 12-15) that are movable based on rotation of the crank handle 38. As shown, the crank handle 38 is meshed with a gear arrangement 44, which in the embodiment shown includes a first gear 46 and a second gear 48 (FIGS. 16-21), that is attached to drive wheels 50. As discussed herein, rotation of the crank handle 38 translates to rotation of the drive wheels 50, which moves the plunger 42 between a position that depresses the round stack or follower in the magazine to make space to add another round. The rotation of the drive wheels 50 also moves pull arms 52 which moves the pusher 40 to a position to push a round 12 into the open space created by the plunger 42 as discussed herein.

Referring to FIGS. 2 and 3, there is shown the speed loader 10 in which a magazine 14 has been inserted into the open end 32 of the magazine receiving portion 24. As discussed herein, the latch mechanism 34 couples the magazine 14 with the magazine receiving portion 24. The user would shake the speed loader 10 to transfer rounds 12 from the hopper 16 into the passageway 26 to the magazine receiving portion 24. The user would rotate the crank handle 38 to load rounds 12 in the passageway 26 into the magazine 14 until the magazine is filled with rounds 12. The user can then actuate the latch mechanism 34 to unlatch the magazine 14 and remove it from the magazine receiving portion 24.

Figure 4:
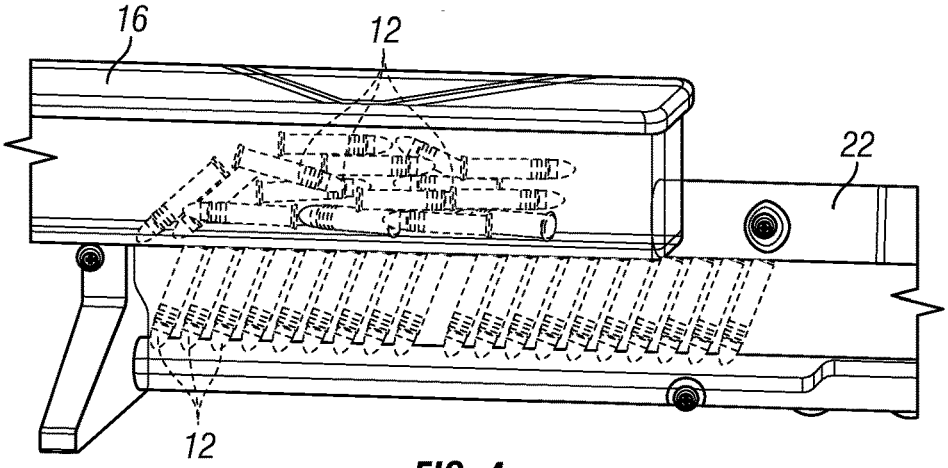
FIG. 4 is a left side detailed perspective view showing a portion of an example hopper and track body according to an embodiment of this disclosure.

FIG. 4 shows a side view of the hopper 16 and track body, each with rounds 12. As shown, the rounds 12 are in an unorganized pile in the hopper 16, but the passageway 26 is configured to arrange the rounds 12 in a single file fashion. Now also referring to FIGS. 5 and 6, the embodiment of the passageway 26 shown, the passageway 26 is elongated with a width to accommodate a single round, which causes the rounds 12 to be arranged in a single file fashion. As shown, the floor 54 of the hopper 16 is sloped towards the passageway 26, which helps in the rounds 12 entering the passageway 26. There is also a shelf 56 on each side of the passageway 26 that is dimensioned to catch the rim portion 58 of the rounds 12. By catching the rim portion 58 of the round 12, the shelf 56 orients the round 12 so that the rim side rides on the shelf 56. This orients the rounds 12 for loading into the magazine 14.

Figure 7:
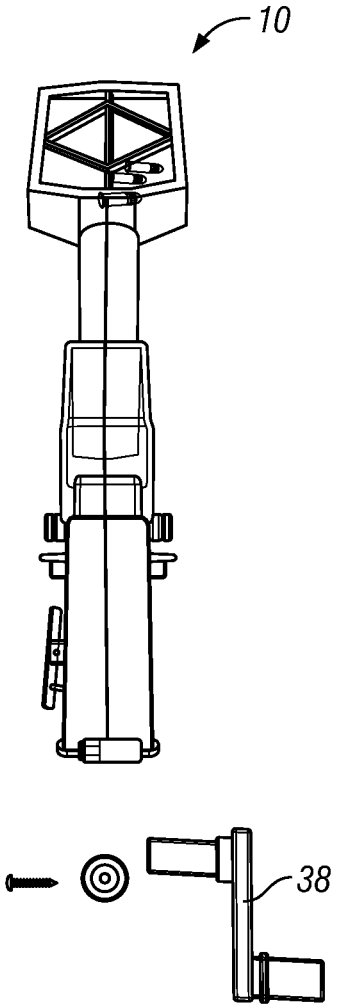
FIGS. 7-9 are top perspective views of the speed loader showing the reversibility of the crank handle from being off the loader, to the right side, and the left side.
Figure 8:
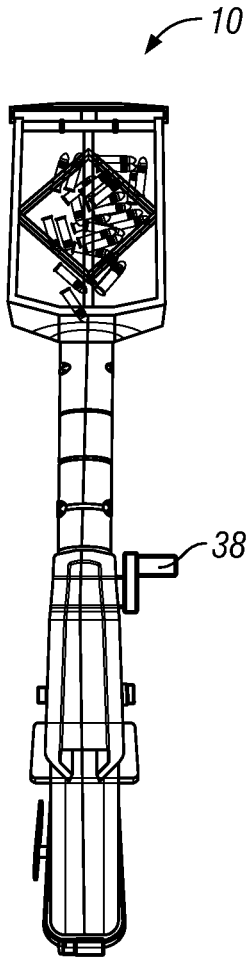
Figure 9:
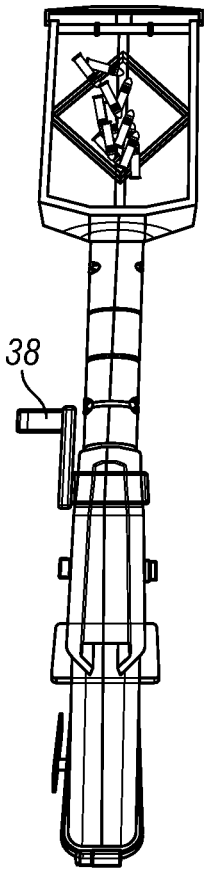

Referring now to FIGS. 7-9, there is shown an example of the crank handle 38. As shown, the crank handle 38 is reversible and may be installed on the speed loader 10 on either the right side or the left side.

Figure 10:
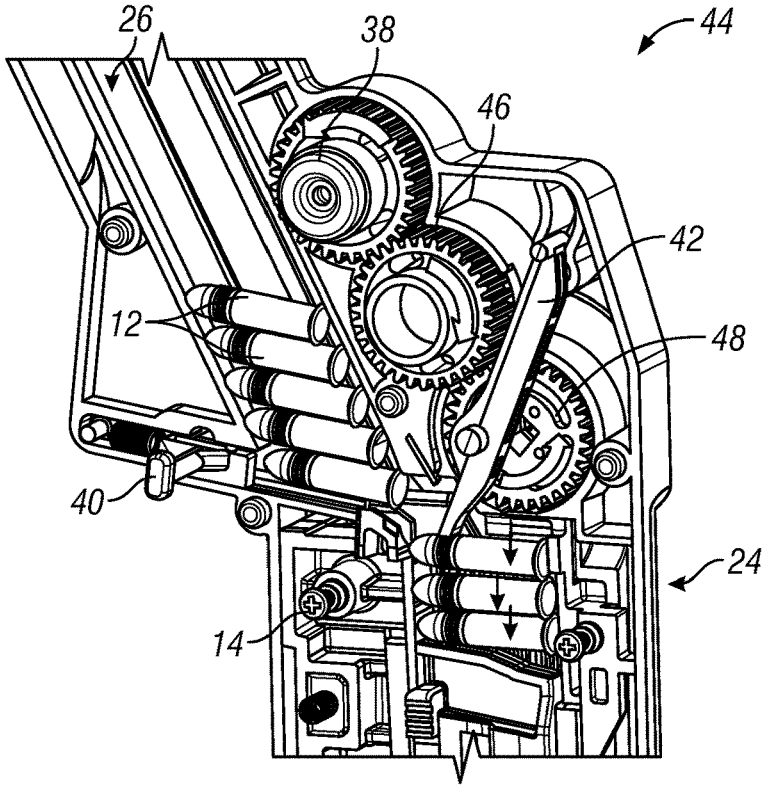
FIG. 10 is left side detailed perspective view with a portion of the housing removed to show certain internal components.
Figure 11:
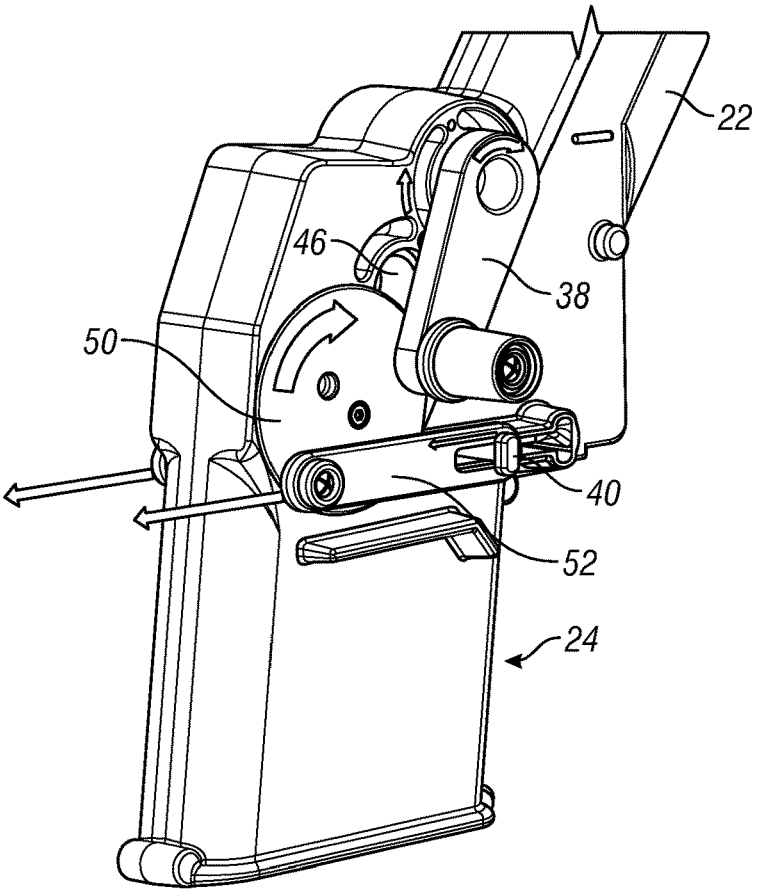
FIG. 11 is a right side detailed perspective view showing the magazine receiving portion.

FIG. 10 shows a portion of the round loading assembly 36 with a portion of the housing of the speed loader 10 removed. In the embodiment shown, there is a plurality of rounds 12 that have traveled from the hopper 16 in the passageway 26 to the magazine receiving portion 24. In this example, a plurality of rounds 12 have already been loaded into the magazine 14. As shown, the plunger 42 has depressed the rounds in the magazine 14 to provide space for the pusher 40 to load the leading round into the magazine 14. Referring also to FIG. 11, as discussed herein, rotating the crank handle 38 rotates the gears 46, 48 to rotate the drive wheels 50, which moves plunger 42, and causes the pull arms 52 to pull the pusher 40 towards the leading round to load the leading round into the magazine 14.

Figure 12:
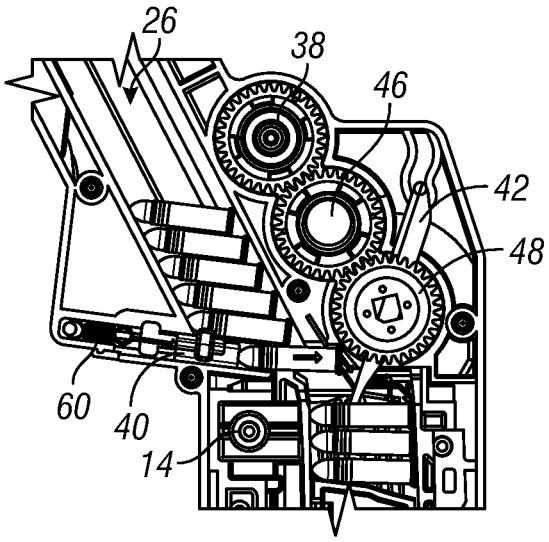
FIGS. 12-15 are left side progressive views of the round loading assembly showing loading of a round into a magazine.
Figure 13:
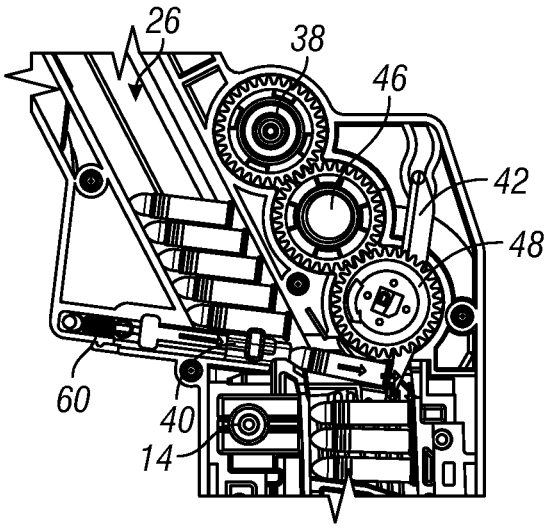
Figure 14:
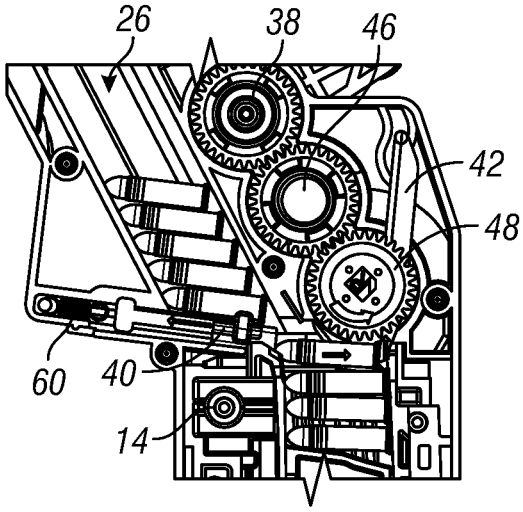
Figure 15:
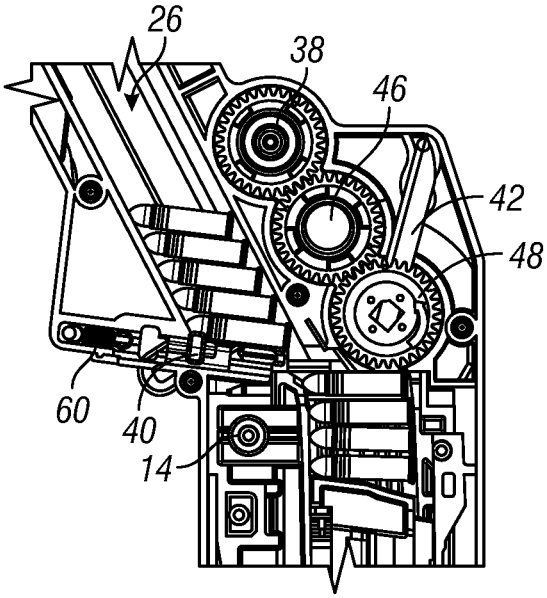
Figure 16:
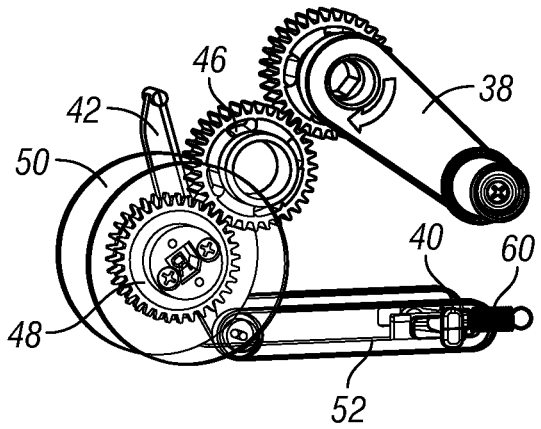
FIGS. 16-21 are right side progressive views of the rounding loading assembly as the crank handle rotates to load a round into a magazine.
Figure 17:
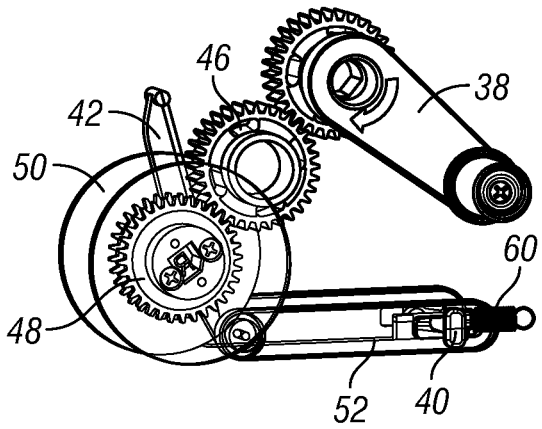
Figure 18:
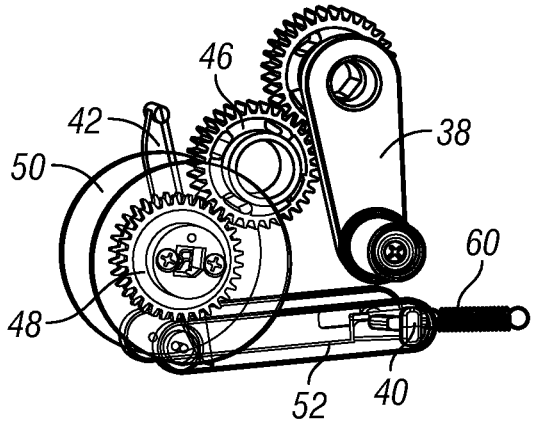
Figure 19:
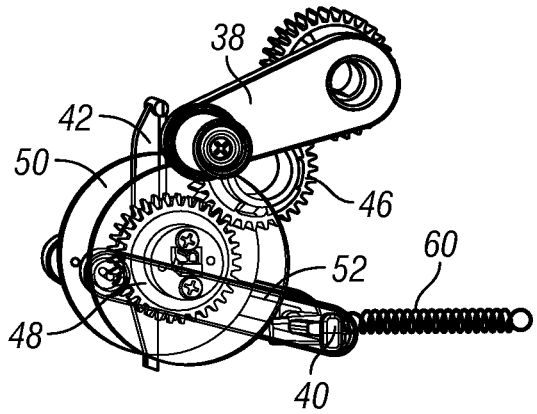
Figure 20:
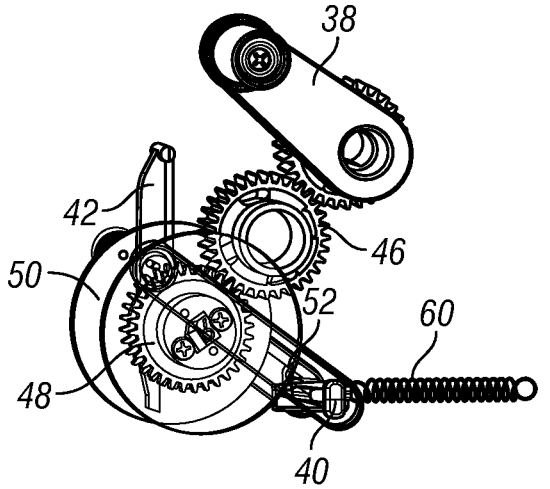
Figure 21:
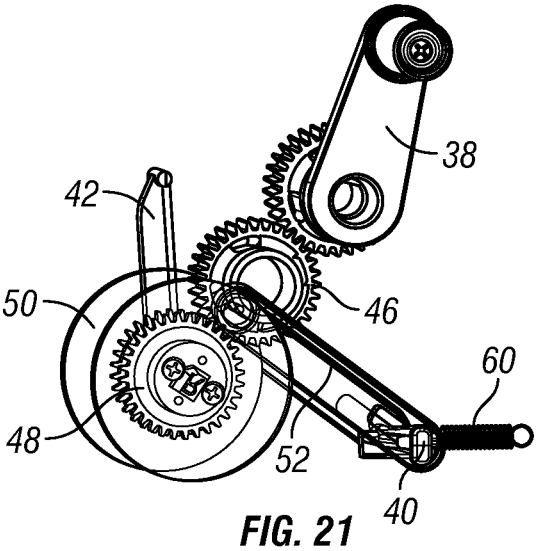

FIGS. 12-15 illustrate the progression of the round loading assembly 36 loading a round into the magazine 14. In FIG. 12, the plunger 42 is engaging the top round to depress the stack of rounds in the magazine 14 to make space for an additional round to be loaded. The pusher 40 has started the movement of pushing the leading round from the passageway 26 into the space to load the round into the magazine 14. In FIG. 13, the crank handle 38 continues to be rotated, which continues to cause the pusher 40 to push the round into the magazine 14. FIG. 14 shows the progression after the round has been loaded into the magazine 14, and the pusher 40 is urged to retract due to the biasing member 60, which could be a spring. As shown in FIG. 15, the pusher 40 has retracted, and the plunger 42 is out of the space in the magazine 14.

FIGS. 16-21 show action of the pusher 40 and plunger 42 as the crank handle 38 is rotated. As shown, the movement of the pull arms 52 responsive to rotation of the drive wheels 50 acts to pull the pusher 40 against the urging of the biasing member 60, which pushes the lading round into the magazine (FIGS. 12-15). Likewise, movement of the drive wheels 50 causes movement of the plunger 42 to depress the round stack in the magazine or the magazine's follower to provide space for the pusher 40 to load the leading round in the passageway 26 into the magazine 14.

Figure 22:
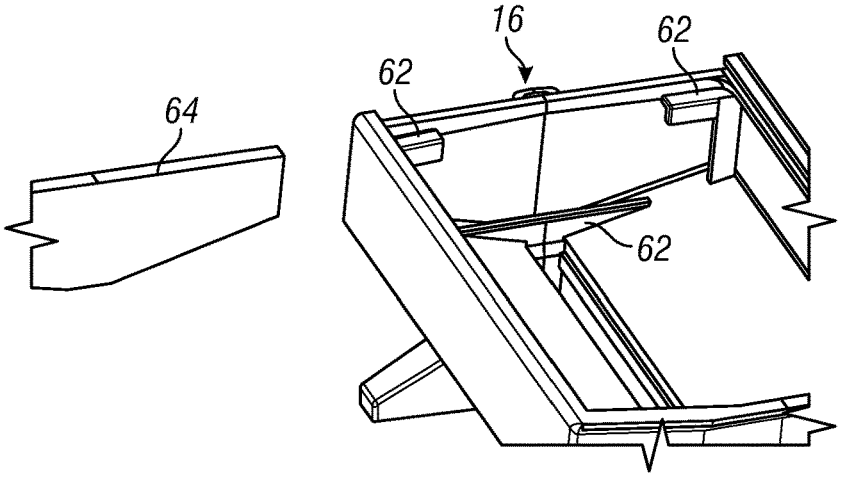
FIG. 22 is a partial perspective view of an example hopper with retention tabs and lubrication pad according to another embodiment of this disclosure.
Figure 23:
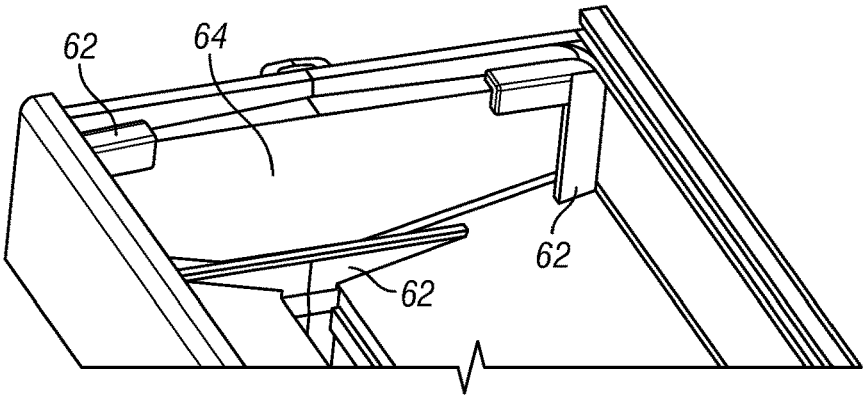
FIG. 23 is a perspective view of the example hopper shown in FIG. 16 with the lubrication pad installed.
Figure 24:
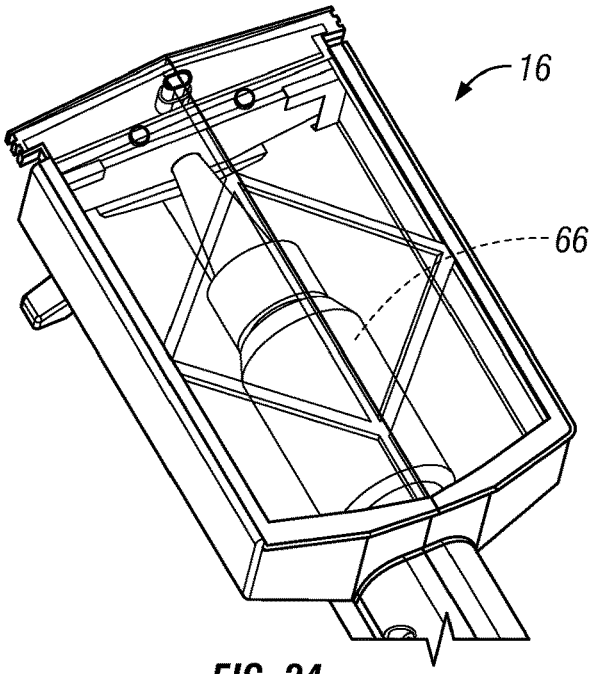
FIG. 24 is a perspective view of the example hopper shown in FIG. 16 with a bottle of cleaner to break down wax build up to be applied to the pad packaged in the hopper.
Figure 25:
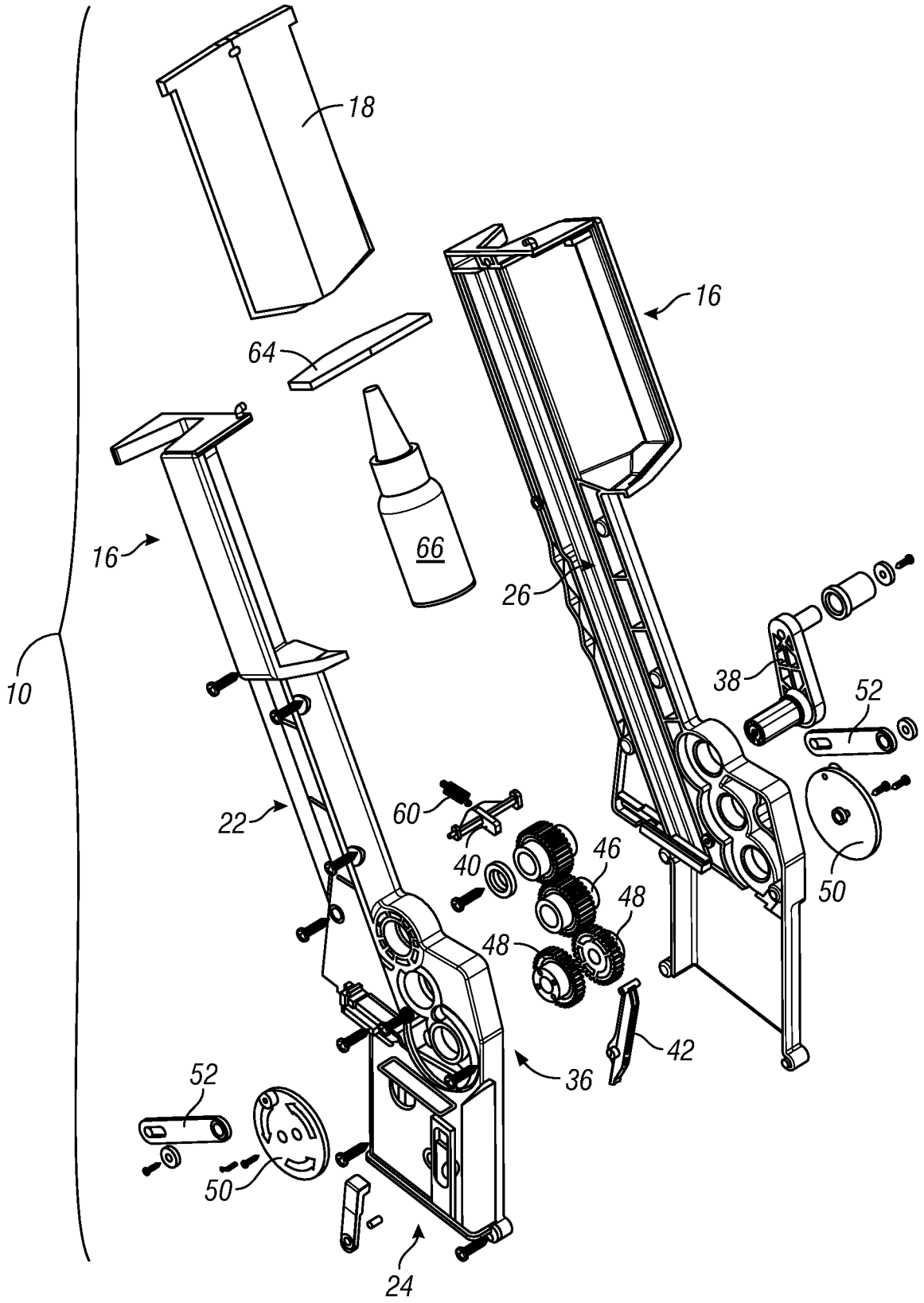
FIG. 25 is an exploded view of an example speed loader according to an embodiment.

FIG. 22 shows an embodiment of the hopper 16 that includes tabs 62 for retaining a pad 64. The pad 64 could be embodied as a felt pad or other material that is able to absorb a fluid. A cleaner to break down wax build up, such as silicon oil, could be applied to the pad 64. In this manner, when the user shakes the speed loader 10 to put rounds in the hopper 16 into the passageway 26, the cleaner to break down wax build up will be applied to the rounds 12 before they are loaded into the magazine 14. This will reduce the tendency for wax build up within the magazine 14 and passageway 26. FIG. 23 shows the pad 64 installed within the hopper 16 using the tabs 62. Of course, other mounting mechanisms or adhesive could be used to install the pad 64 within the hopper 16. Also, the pad 64 could be installed on a different interior wall of the hopper or multiple walls, if desired. In some cases, such as shown in FIG. 24, a bottle 66 of the cleaner to break down wax could be sized to fit within the hopper 16 for compact shipping. FIG. 25 shows an exploded view of the example speed loader 10 according to one or more embodiments as discussed herein.

The invention claimed is:

1. A speed loader comprising:

a hopper configured to receive a plurality of rounds of ammunition, wherein an interior of the hopper includes a lubrication surface configured to coat one or more of the plurality of rounds within the hopper with a cleaner;

a magazine receiving portion configured to receive an open end of a magazine;

a track body extending between the hopper and the magazine receiving portion, wherein the track body defines a passageway dimensioned to transfer one or more of the plurality of rounds from the hopper to the magazine receiving portion, wherein the passageway is configured to orient rounds in a single file fashion between the hopper and the magazine receiving portion; and a round loading assembly configured to successively load rounds from the passageway into the open end of the magazine.

2. The speed loader of claim 1, wherein at least a portion of the passageway extends into the hopper, wherein the passageway is arranged in the hopper so at least a portion of the plurality of rounds in the hopper are gravity fed into the passageway.

3. The speed loader of claim 1, wherein the hopper includes an opening covered by a lid that is movable between an open position to receive one or more rounds into the hopper and a closed position to prevents the plurality of rounds from exiting the hopper.

4. The speed loader of claim 3, wherein the lid is slidable between open and closed positions.

5. The speed loader of claim 3, wherein the hopper is dimensioned to receive up to approximately 100 rounds.

6. The speed loader of claim 1, wherein the lubrication surface comprises a pad configured to be saturated with the cleaner to break down wax build up.

7. The speed loader of claim 6, wherein the hopper includes a side wall with one or more tabs to retain the pad.

8. The speed loader of claim 7, wherein the pad is at least partially formed from felt.

9. The speed loader of claim 8, wherein the cleaner to break down wax build up comprises silicon oil.

10. The speed loader of claim 1, wherein the magazine receiving portion includes a latch mechanism configured to selectively retain a magazine in the magazine receiving portion.

11. The speed loader of claim 1, wherein an external surface of the track body includes a plurality of finger grooves.

12. The speed loader of claim 1, wherein the passageway extends along a longitudinal axis of the track body between the hopper and a magazine receiving portion.

13. The speed loader of claim 12, wherein the passageway is configured to orient rounds in the passageway into a stack in which a longitudinal axis of at least a portion of the rounds are transverse with the longitudinal axis of the passageway.

14. The speed loader of claim 13, wherein the track includes a shelf surrounding the passageway, wherein the shelf is arranged to catch a rim portion of each round of the plurality of rounds in the passageway.

15. The speed loader of claim 1, wherein the round loading assembly includes a crank handle configured to sequentially load rounds into the magazine responsive to rotation of the crank handle.

16. The speed loader of claim 15, wherein the round loading assembly includes a pusher that reciprocates between an extended position in which the pusher engages a round in the passageway and a retracted position in which the pusher does not engage a round in the passageway in response to rotation of the crank handle.

17. A speed loader comprising:

a hopper configured to receive a plurality of rounds of ammunition;

a magazine receiving portion configured to receive an open end of a magazine;

a track body extending between the hopper and the magazine receiving portion, wherein the track body defines a passageway dimensioned to transfer one or more of the plurality of rounds from the hopper to the magazine receiving portion, wherein the passageway is configured to orient rounds in a single file fashion between the hopper and the magazine receiving portion; and a round loading assembly including a crank handle configured to sequentially load rounds into the magazine responsive to rotation of the crank handle, wherein the round loading assembly includes a pusher that reciprocates between an extended position in which the pusher engages a round in the passageway and a retracted position in which the pusher does not engage a round in the passageway in response to rotation of the crank handle, and wherein the round loading assembly includes a biasing member configured to urge the pusher towards the retracted position.

18. The speed loader of claim 17, wherein the round loading assembly includes a plunger configured to move between (i) a depressed position in which the plunger depresses a stack of rounds in a magazine or a follower of the magazine and (ii) a reset position in which the plunger moves to a position that does not engage the stack of rounds in the magazine or the follower of the magazine responsive to rotation of the crank handle.

19. The speed loader of claim 18, wherein the round loading assembly includes a gear arrangement coupled with the crank handle to sequentially move (i) the plunger to a depressed position, and (ii) the pusher to the extended position to load a round into the magazine.

20. A method of loading rounds of ammunition into a magazine of a firearm, the method comprising:

loading a plurality of rounds into a hopper of a speed loader;

applying a cleaner to break down wax build up to an interior surface of the hopper;

shaking the speed loader until at least a portion of the rounds have entered a passageway extending from the hopper of the speed loader, wherein shaking the speed loader coats at least a portion of the plurality of rounds with the cleaner;

locking a magazine into a loading end of the speed loader; and rotating a crank handle of the speed loader to load rounds from the passageway into the magazine, wherein the speed loader includes a round loading assembly configured to successively load rounds from the passageway into the magazine responsive to rotating the crank handle.

* * * * *